US006135848A

United States Patent [19]

Hou

[11] Patent Number: 6,135,848

[45] Date of Patent: Oct. 24, 2000

[54] ELEVATABLE AND SWAYABLE TOY STRUCTURE

[76] Inventor: Chin-Jung Hou, 58, Ma Yuan West St., Taichung, Taiwan

[21] Appl. No.: 09/420,225

[22] Filed: Oct. 18, 1999

[51] Int. Cl.[7] ..... A63H 11/00

[52] U.S. Cl. ..... 446/353; 446/268

[58] Field of Search ..... 446/268, 297, 446/298, 353, 354, 308, 309, 320, 330, 373, 376, 487

[56] References Cited

U.S. PATENT DOCUMENTS

| | | | |
|---|---|---|---|
| 1,606,070 | 11/1926 | Gibson | 446/330 |
| 3,797,166 | 3/1974 | Murray | 446/320 |
| 4,901,459 | 2/1990 | Lee | 446/353 X |
| 4,913,676 | 4/1990 | Koguchi et al. | 446/353 X |
| 5,147,238 | 9/1992 | Kelley et al. | 446/268 X |
| 6,017,261 | 1/2000 | Wachtel | 446/353 X |

*Primary Examiner*—Sam Rimell

[57] ABSTRACT

A toy structure includes a base, a power transmission device, a guide plate, an elevating device, a carrier, a swaying device, and an auxiliary support rod. The elevating device is mounted in a container. When power is turned on, an arm and a drawing member are activated by the power transmission device to move upward. The elevating device is actuated such that the carrier is lifted. Front and rear supports mounted on top of the carrier are also lifted to move the toy figure, including the body and the head, beyond the container. The swaying device is activated to sway leftward and rightward for a period of time with a music integrated circuit playing music.

1 Claim, 7 Drawing Sheets

ELEVATABLE AND SWAYABLE TOY STRUCTURE

BACKGROUND OF THE INVENTION

1. Field of the Invention

The present invention relates to a toy structure with a portion that can be elevated and swayed for fun or trick.

2. Description of the Related Art

Toys are popular among children, and continuous innovations in the looks and motions of toys concentrate on attracting and astonishing children. The present invention is intended to provide a toy structure to meet this end.

SUMMARY OF THE INVENTION

A toy structure in accordance with the present invention comprises:

a base of a predetermined shape and including a mounting portion and a plurality of first pegs of different heights, the base further including an integrated circuit for providing music;

a power transmission device including a power source and an output shaft for driving an arm, the arm including an end with a protrusion, a drawing member including a horizontal guide slot through which the protrusion extend of the arm is slidably extended, the drawing member including a drawing section projected from a side thereof;

a guide plate mounted to the base and including a first central vertical slot and two vertical grooves, the drawing section of the drawing member slidably extending through the first central vertical slot of the guide plate, the drawing member including two end portions engaged and thus slidably guided in the vertical grooves of the guide plate, an upper limit switch and a lower limit switch being mounted on the guide plate for activating/deactivating the integrated circuit, the guide plate further including a plurality of second pegs of different lengths projected from a first side thereof for mounting the power transmission device, the guide plate further including a guide protrusion on a second side thereof;

an elevating device including a lazy-tongs having a lower end secured to the guide plate, the lazy-tongs consisting of a plurality of ribs, at least one of the ribs located in a mediate portion of the lazy-tongs being secured to the drawing section of the drawing member to move therewith;

a carrier adapted to carrying a toy figure to move therewith, the carrier including a second central vertical slot in which the guide protrusion of the guide plate is slidably guided, the carrier further including two horizontal slots for slidably receiving and guiding two ends respectively of two uppermost said ribs of the lazy-tongs, thereby connecting the carrier to the lazy-tongs, the carrier further including a plurality of third pegs;

a swaying device adapted to be received in the toy figure for swaying the toy figure when the swaying device is actuated to sway, the swaying device including a swaying member with and a second power source for swaying the swaying member, the swaying member including a front support and a rear support respectively secured to two sides thereof, the front support being secured to the third pegs of the carrier, a support being provided on top of the swaying member and adapted to support a head portion of the toy figure, a front protrusion projecting from a front side of the swaying member and extending through the front support, a rear protrusion projecting from a rear side of the swaying member and extending through a rear support, thereby pivotally mounting the swaying seat between the front support and the rear support, each of the front and rear supports having a lower end secured to a rectangular connecting member; and an auxiliary support rod providing a stable support during upward and downward movements of the toy structure, a carrier sleeve consisting of two half pieces that are connected together and slidably mounted to the auxiliary support rod, thereby securely connecting the carrier sleeve to the rear support to move therewith, the support rod having a lower end secured to the base and located between two said first pegs.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
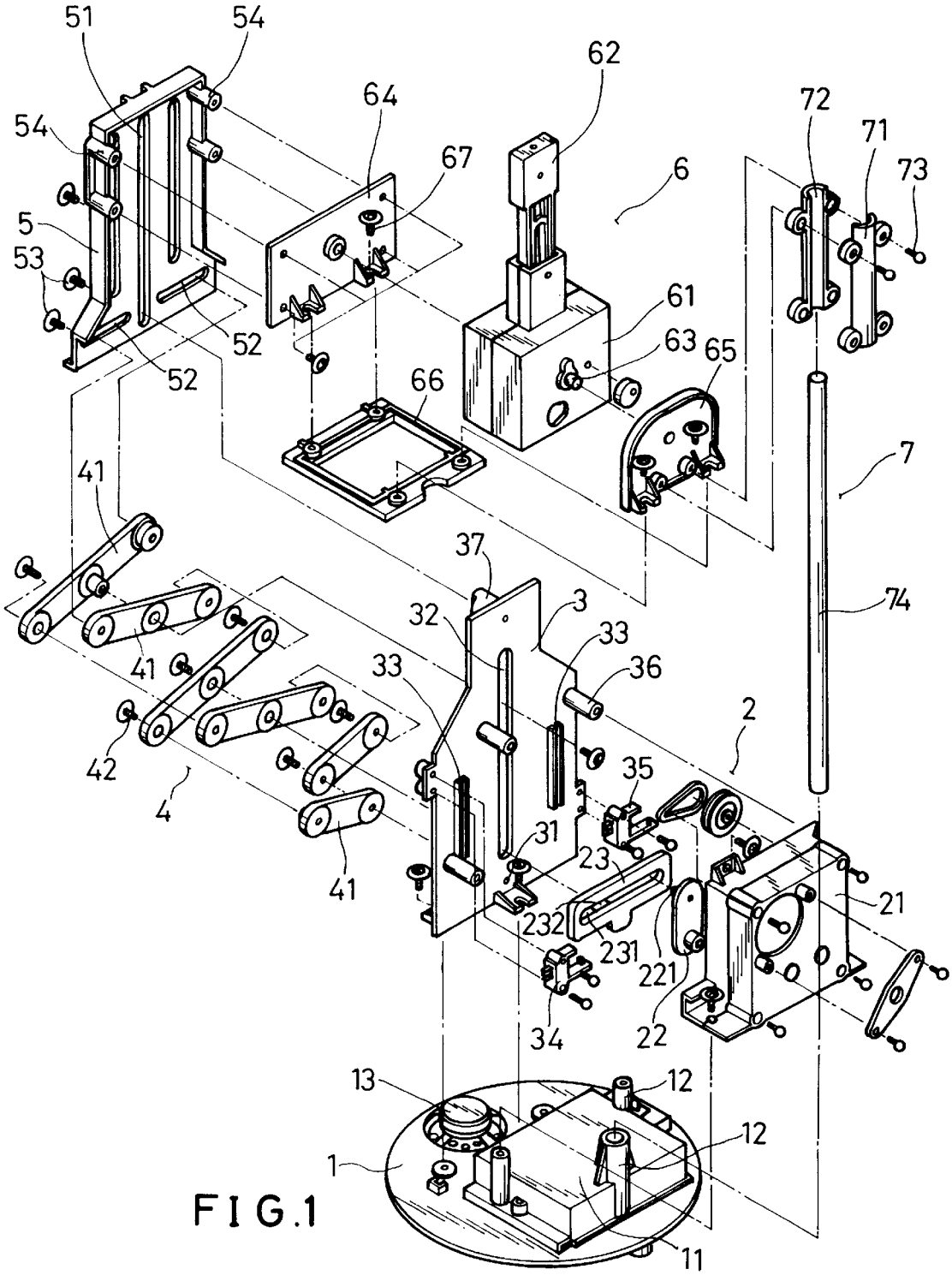
FIG. 1 is an exploded perspective view of a toy structure in accordance with the present invention.
Figure 2:
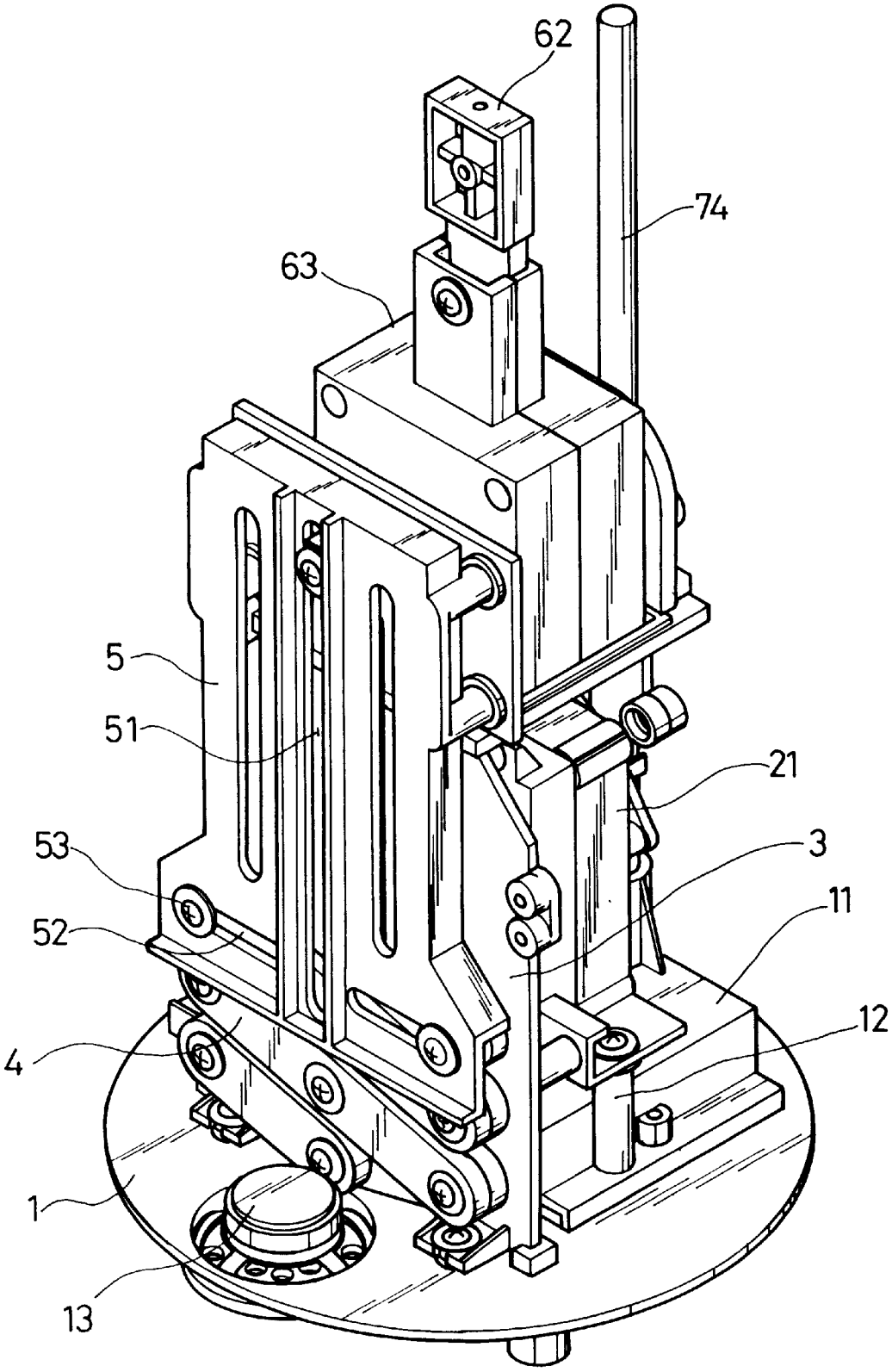
FIG. 2 is a perspective view of the toy structure in accordance with the present invention.

Referring to FIGS. 1 and 2, a toy structure in accordance with the present invention generally includes a base 1, a power transmission device 2, a guide plate 3, an elevating device 4, a carrier 5, a swaying device 6, and an auxiliary support rod 7.

The base 1 has a predetermined shape and includes a mounting portion 11 and a number of pegs 12 of different heights. In addition, an integrated circuit (IC) 13 is mounted on the base 1 to provide background music during motion of the toy structure.

The power transmission device 2 includes a power source 21 that has been retarded according to the need of elevation of the toy structure. The power source 21 has an output shaft (not labeled) connected to an arm 22 having an end with a protrusion 221 extended through a guide slot 231 of a drawing member 23. The drawing member 23 includes a drawing section 232 that projects outward from a side thereof and extends through a vertical guide slot 32 of the guide plate 3.

The guide plate 3 provides a support during upward and downward movement of the toy structure. The guide plate 3 is secured to the base 1 by bolts or screws 31. The vertical slot 32 is defined in a central area of the guide plate 3. The guide plate 3 farther includes two vertical guide grooves 33 to slidably receive protruded portions (not shown) on two sides of the drawing member 23 of the power transmission device 2. Limit switches 34 and 35 are mounted to upper and lower portions of the guide plate 3 to activate or deactivate the IC 13 when the drawing member 23 reaches a predetermined level and thus actuates the limit switches 34 and 35. A number of pegs 36 of different lengths project outward from a side of the guide plate 3 for mounting the power transmission device 2. The guide plate 3 further includes a guide protrusion 37 on the other side thereof, the guide protrusion 37 being extended through and thus guided in a central vertical slot 51 of the carrier 5.

The elevating device 4 includes a lazy-tongs consisting of a plurality of ribs 41 that are connected by screws or rivets 42. A lower end of the lazy-tongs is secured to the guide plate 3. A screw or rivet 42 may be extended through one of the middle ribs 41 and engaged with the drawing section 232 slidably guided in the vertical slot 32 of the guide plate 3 to thereby guide vertical movement of the lazy-tongs. Upper ends of two uppermost ribs 41 of the lazy-tongs are slidably guided in two horizontal slots 52 of the carrier 5.

The carrier 5 is provided to carry a toy FIG. 8 (FIG. 7) to move therewith. Screws or rivets 53 are provided to connect the upper end of the lazy-tongs to the carrier 5. The carrier 5 further includes a number of pegs 54 projected from a side thereof for mounting a front support 64 of the swaying device 6.

The swaying device 6 is provided to sway the toy FIG. 8. The swaying device 6 includes a swaying member 61 driven by (after proper reduction) a power source mounted in the swaying device. A support 62 is provided on top of the swaying member 61 for supporting a head portion of the toy FIG. 8. A front protrusion (not shown, see reference numeral 63 in FIG. 1 for reference) projects from a front side of the swaying member 61 and extends through the front support 64. A rear protrusion 63 projects from a rear side of the swaying member 61 and extends through a rear support 65. Thus, the swaying member 61 is pivotally mounted. Lower ends of the front and rear supports 64 and 65 are secured to a rectangular connecting member 66 by screw or rivets 67.

The auxiliary support rod 7 (in the form of a rod 74) provides a stable support during upward and downward movements of the toy structure. A carrier sleeve, consisting of two half pieces 71 and 72 connected together by screws 73, is slidably mounted to the support rod 74. The screws 73 also connect the carrier sleeve 71, 72 to the rear support 65 to move therewith. The support rod 74 has a lower end secured to the base 1 and located between two pegs 12.

Figure 3:
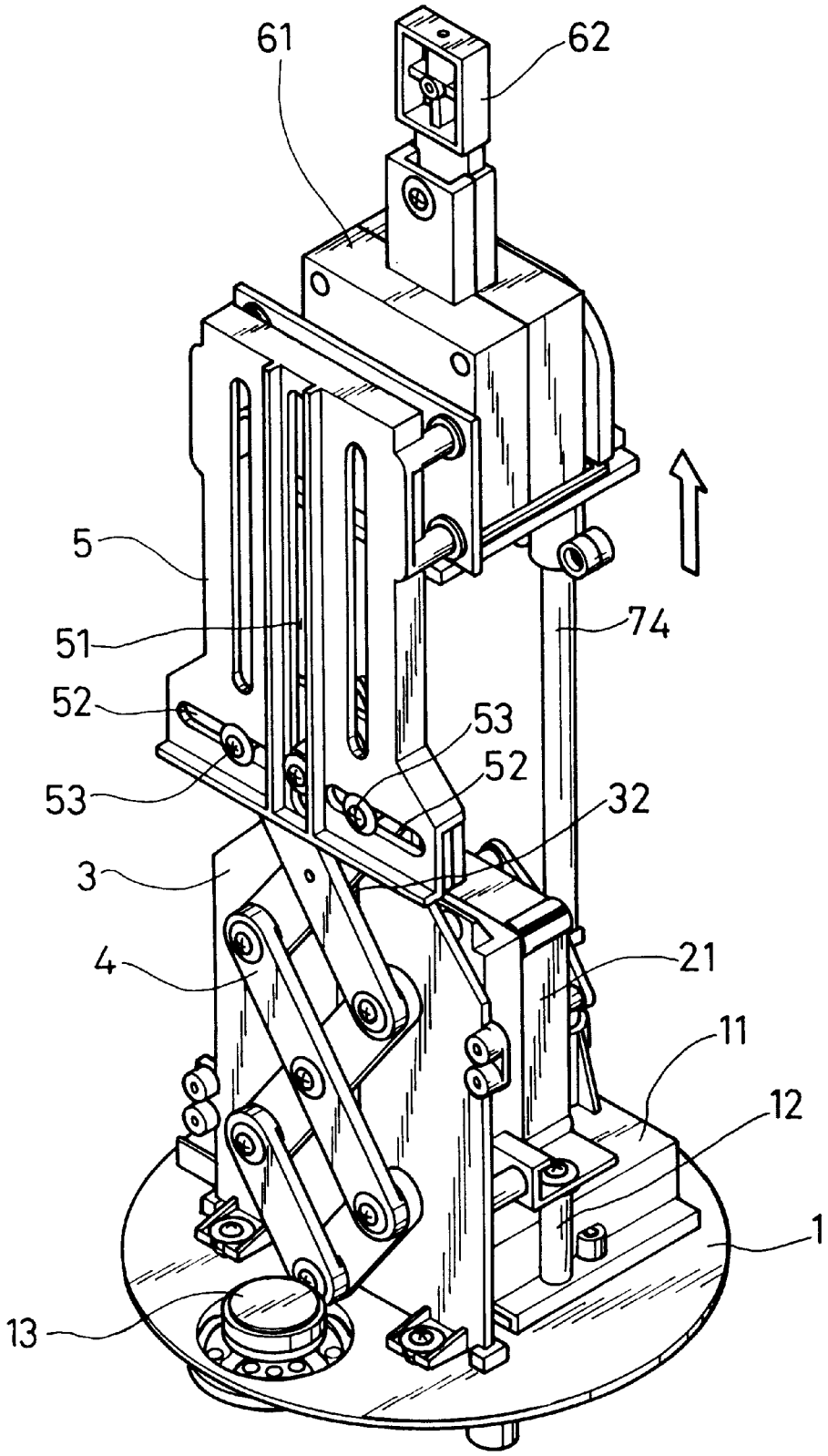
FIG. 3 is a perspective view illustrating upward movement of a portion of the toy structure.
Figure 4:
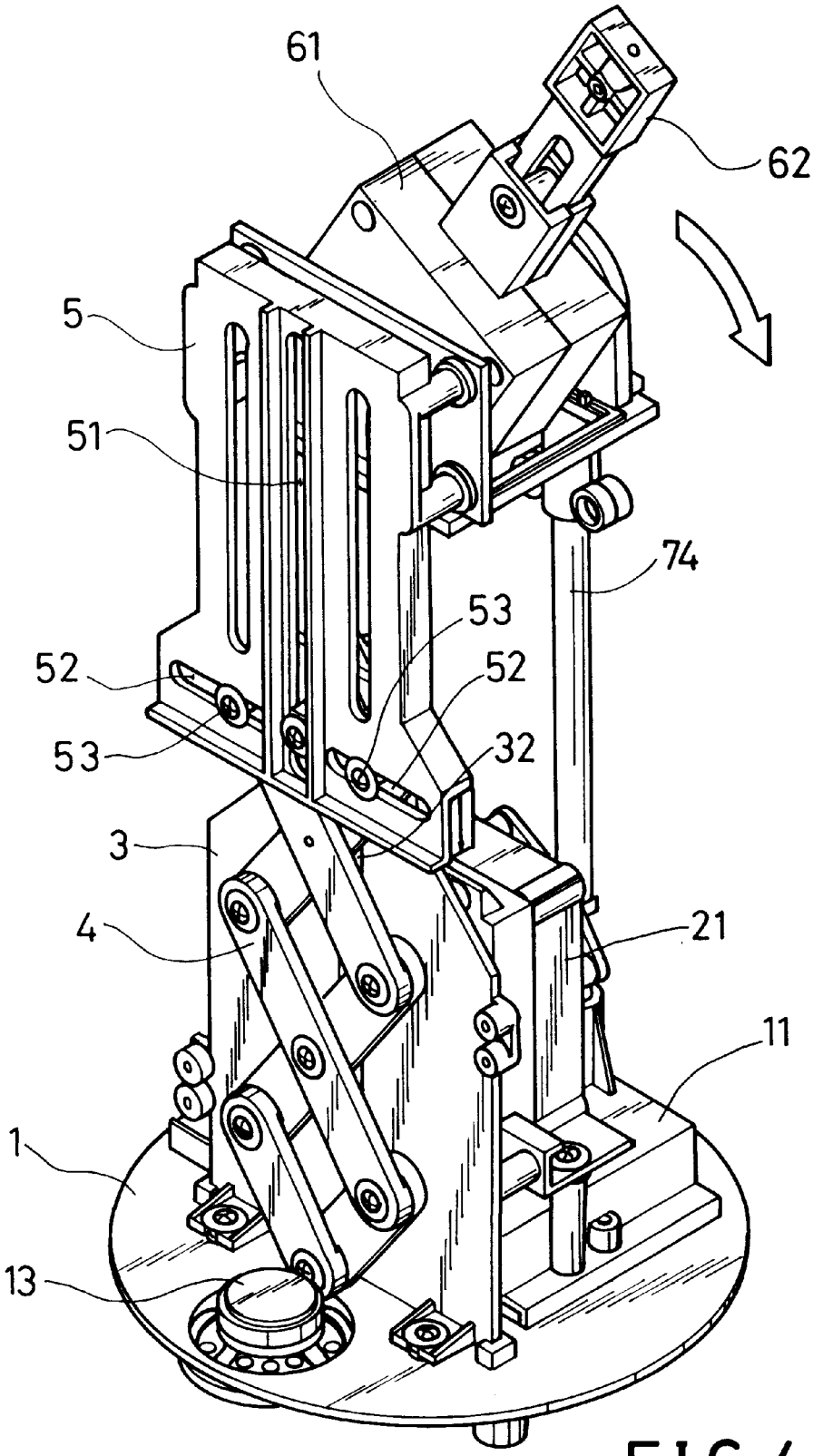
FIG. 4 is a perspective view illustrating rightward swaying motion of the portion of the toy structure.
Figure 5:
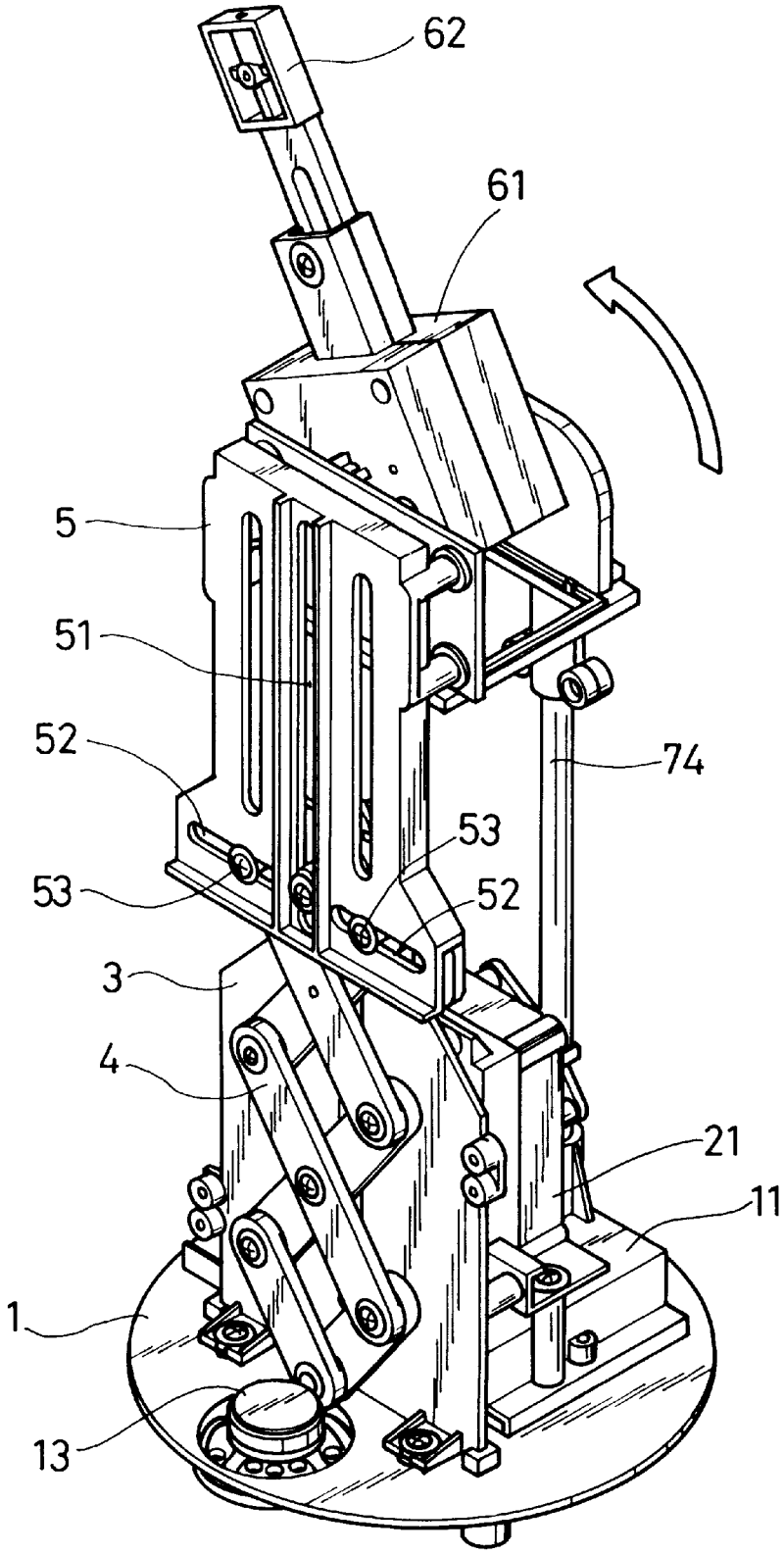
FIG. 5 is a perspective view illustrating leftward swaying motion of the portion of the toy structure.
Figure 6:
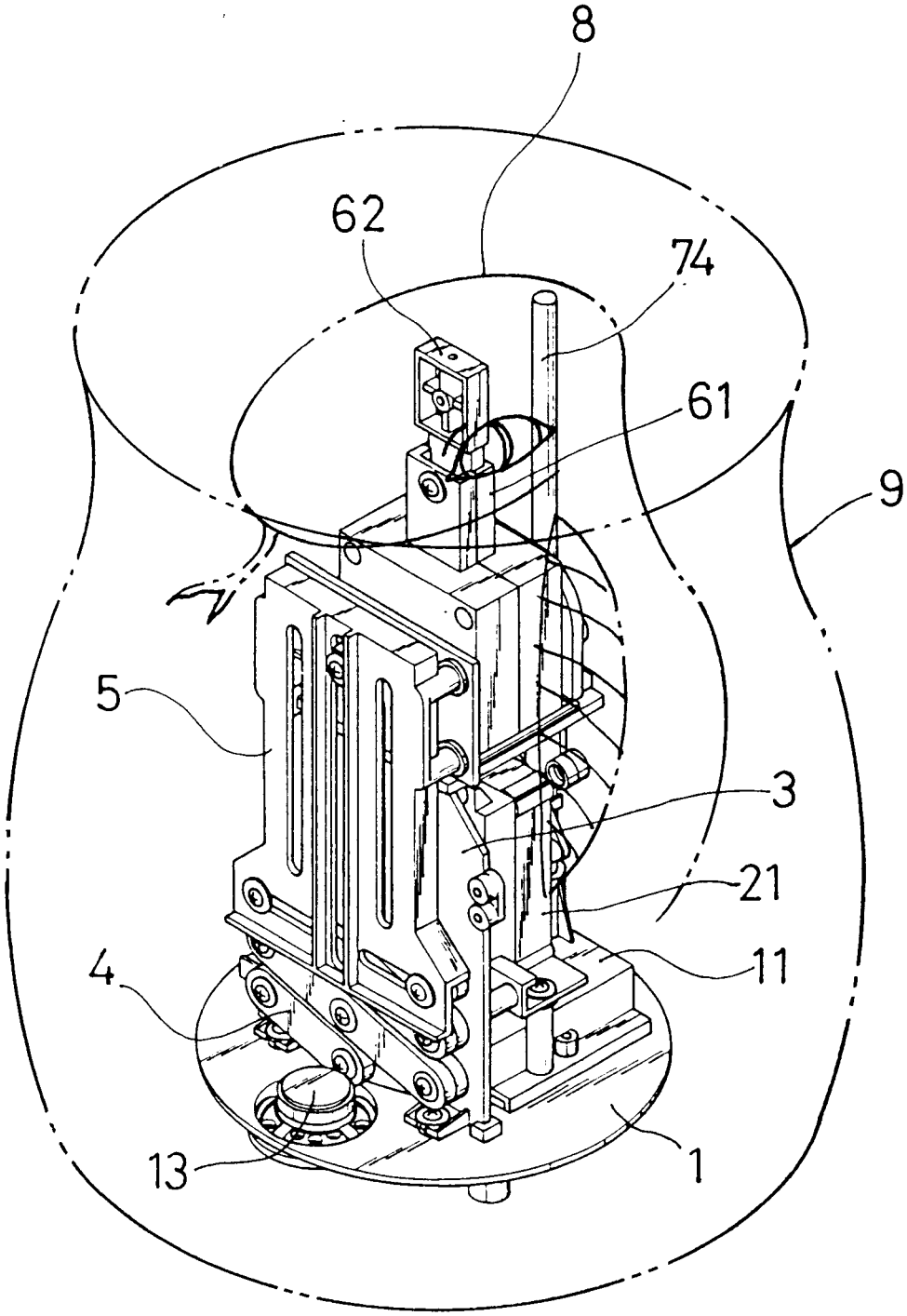
FIG. 6 is a schematic perspective view illustrating hiding of the toy structure in a container.
Figure 7:
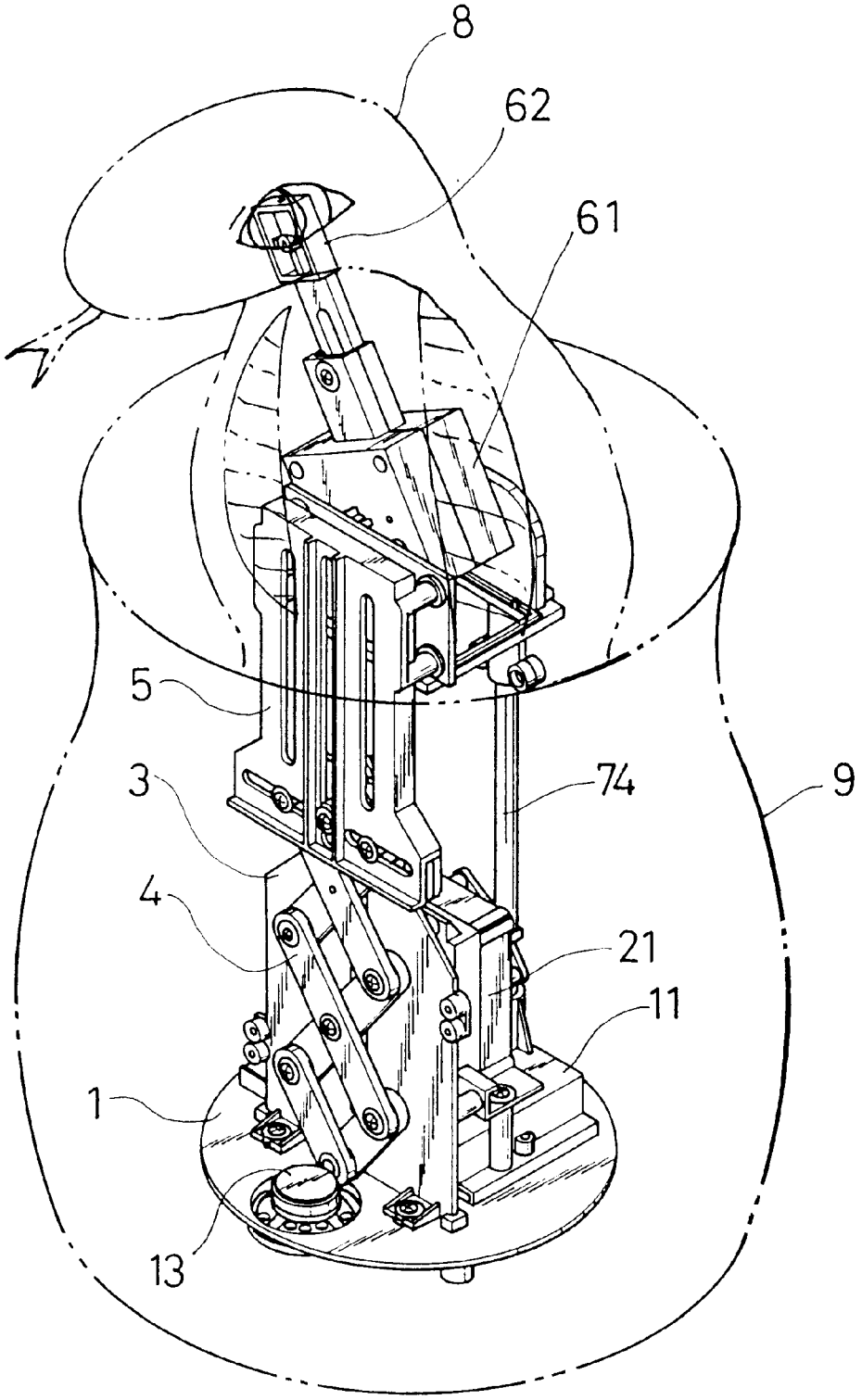
FIG. 7 is a view similar to FIG. 6, wherein the portion of the toy structure is moved beyond the container.

The toy structure of the present invention is placed in a container 9 with an appropriate depth (FIG. 6). When the power source is turned on, the arm 22 and the drawing member 23 are activated by the power transmission device 2 to move upward (FIG. 3). The lazy-tongs (the elevating device 4) is actuated such that the carrier 5 is lifted. The front and rear supports 64 and 65 mounted on top of the carrier 5 are also lifted. As a result, the toy FIG. 8 (including the body and the head) moves beyond the container 9 (FIG. 7). The swaying device 6 is activated to sway leftward and rightward (FIGS. 4 and 5) for a predetermined period of time with the music IC 13 playing music. The power transmission device 2 is activated to lower the lazy-tongs 4 and the carrier 5 to hide the toy structure 8 in the container 9, and the music IC 13 stops. Thus, continuous movements are completed within a predetermined period of time, providing a lively, new, dynamic toy structure.

Although the invention has been explained in relation to its preferred embodiment, it is to be understood that many other possible modifications and variations can be made without departing from the spirit and scope of the invention as hereinafter claimed.

What is claimed is:

1. A toy structure comprising:

a base of a predetermined shape and including a mounting portion and a plurality of first pegs of different heights, the base further including an integrated circuit for providing music;

a power transmission device including a power source and an output shaft for driving an arm, the arm including an end with a protrusion, a drawing member including a horizontal guide slot through which the protrusion extend of the arm is slidably extended, the drawing member including a drawing section projected from a side thereof;

a guide plate mounted to the base and including a first central vertical slot and two vertical grooves, the drawing section of the drawing member slidably extending through the first central vertical slot of the guide plate, the drawing member including two end portions engaged and thus slidably guided in the vertical grooves of the guide plate, an upper limit switch and a lower limit switch being mounted on the guide plate for activating/deactivating the integrated circuit, the guide plate further including a plurality of second pegs of different lengths projected from a first side thereof for mounting the power transmission device, the guide plate further including a guide protrusion on a second side thereof;

an elevating device including a lazy-tongs having a lower end secured to the guide plate, the lazy-tongs consisting of a plurality of ribs, at least one of the ribs located in a mediate portion of the lazy-tongs being secured to the drawing section of the drawing member to move therewith;

a carrier adapted to carrying a toy figure to move therewith, the carrier including a second central vertical slot in which the guide protrusion of the guide plate is slidably guided, the carrier further including two horizontal slots for slidably receiving and guiding two ends respectively of two uppermost said ribs of the lazy-tongs, thereby connecting the carrier to the lazy-tongs, the carrier further including a plurality of third pegs;

a swaying device adapted to be received in the toy figure for swaying the toy figure when the swaying device is actuated to sway, the swaying device including a swaying member with and a second power source for swaying the swaying member, the swaying member including a front support and a rear support respectively secured to two sides thereof, the front support being secured to the third pegs of the carrier, a support being provided on top of the swaying member and adapted to support a head portion of the toy figure, a front protrusion projecting from a front side of the swaying member and extending through the front support, a rear protrusion projecting from a rear side of the swaying member and extending through a rear support, thereby pivotally mounting the swaying seat between the front support and the rear support, each of the front and rear supports having a lower end secured to a rectangular connecting member; and an auxiliary support rod providing a stable support during upward and downward movements of the toy structure, a carrier sleeve consisting of two half pieces that are connected together and slidably mounted to the auxiliary support rod, thereby securely connecting the carrier sleeve to the rear support to move therewith, the support rod having a lower end secured to the base and located between two said first pegs.

* * * * *